United States Patent [19]

Mariner

[11] 4,030,396

[45] June 21, 1977

[54] ACOUSTIC PICKUPS

[76] Inventor: Ralph E. Mariner, 2060 S. Patton Court, Denver, Colo. 80219

[22] Filed: Oct. 17, 1975

[21] Appl. No.: 623,450

[52] U.S. Cl. ..... 84/1.16; 84/DIG. 24; 310/9.1

[51] Int. Cl.[2] ..... G10H 3/00; H01V 7/00

[58] Field of Search ..... 84/1.04, 1.14, 1.16, 84/DIG. 24; 310/9.1; 179/1 M

[56] References Cited

UNITED STATES PATENTS

| | | | |
|---|---|---|---|
| 3,624,264 | 11/1971 | Lazarus | 84/1.14 |
| 3,733,425 | 5/1973 | Chaki | 84/1.14 |
| 3,891,869 | 6/1975 | Scarpa | 310/8.2 |

*Primary Examiner*—E. S. Jackmon
*Attorney, Agent, or Firm*—Van Valkenburgh and Lowe

[57] ABSTRACT

A pickup for a musical instrument to be mounted upon the musical instrument to amplify the tones thereof. The invention consists in adding a mass significantly greater than the weight of the transducer within the pickup in such a manner as to permit the transducer to act against this mass when picking up vibrations, with the result of improving and sustaining tones produced by the instrument, and also, in significantly increasing the output of the transducer.

11 Claims, 14 Drawing Figures

ACOUSTIC PICKUPS

This invention relates to sonic transducers, sometimes called electro-acoustic transducers, which convert acoustic energy into electric energy. Such are commonly called "pickups" and the invention relates, more particularly, to pickups for stringed musical instruments.

The pickups used with musical instruments include crystal and magnetic types. The crystal types function through piezoelectric action by pressure with very small distortions of the crystal, while magnetic pickups function through inductance changes responsive to movement of an armature or movement of a steel string of a steel guitar. In both instances, the electrical energy output is of the same nature, a cyclic current or voltage reproducing the sound vibrations produced by the musical instrument, so the same may be electronically amplified and the output at a speaker again producing the same amplified sound vibrations. The criterion for the design of a good pickup is high fidelity in responding to the tone of the instrument. A number of different types of pickups are available for all sorts of musical instruments and most of these pickups will faithfully and accurately reproduce the tones of the instrument.

This means that if the instrument is of good quality and emits a good tone, the pickup will cause a proper amplifying system, including the speaker, to emit a corresponding good tone. Likewise, if the instrument is of a low quality and/or is poorly adjusted to emit a harsh or unpleasant dissonant sound along with the musical tones, the pickup will cause the amplifying system to emit the same kind of a dissonant sound.

The purpose of the present invention is to supplement a conventional pickup so that the pickup is capable of better responding to the tones produced by the strings of a stringed instrument, and especially the strings of a poor quality stringed instrument. The invention disclosed herein is especially suitable for being applied to stringed instruments, more so than for types of instruments such as wind instruments and percussion instruments. The invention comprises, in essence, the addition of mass to a pickup in a manner which modifies the action of the transducer element of the pickup to more selectively respond to the tones of the strings and to override undesirable overtones and off-pitch tones which are produced by the acoustic body of the instrument. With the proper addition of mass to the pickup, good quality string tones can be obtained in a poor quality instrument which otherwise chops off, dampens or distorts the string tones. In doing so, the proper addition of mass to a pickup also significantly improves the amplification or output of the pickup, even to the point where preamplifiers necessary on some pickup sysems can be eliminated.

It was discovered that not only would a pickup, supplemented with a mass according to the invention, respond to string tones and override undesirable overtones and off-pitch tones of the acoustic body of an instrument, but, also, the pickup could be used to produce good quality tones when the acoustic body of the musical instrument was eliminated. For example, a stick carrying strings can be made to sound like a guitar or violin having a high quality sound box.

It follows that an object of the invention is to provide a novel and improved pickup for a stringed instrument which is especially sensitive and responsive to the vibrating strings to more accurately respond to the tones generated by the vibrating strings.

Another object of the invention is to provide a novel and improved pickup for a stringed instrument which produces good quality tones regardless of the type of instrument or the quality of craftsmanship used in the manufacture and design of the instrument.

Another object of the invention is to provide a novel and improved pickup for a stringed instrument which is capable of responding directly to the string vibrations even as the string vibrations attenuate to thereby sustain a tone and eliminate tone cutoff characteristic of conventional pickups.

Another object of the invention is to provide a novel and improved pickup by a simple modification of conventional pickups which permits a significant improvement in the quality of the pickup output and, thus, permits a low quality, cheap pickup to perform as if it were a high quality, expensive unit.

Another object of the invention is to provide an improved pickup for stringed instruments by a simple modification of a conventional pickup which eliminates, in many instances, the need for preamplifier circuits by increasing the output of the pickup to the point where the need for a preamplifier circuit is eliminated and the pickup may be amplified directly in the speaker circuit.

A further object of the present invention is to provide a novel and improved pickup which may be used to amplify the tones of various types of stringed instruments, with instruments having fully acoustic bodies, semi-acoustic bodies and solid bodies and even with practice sticks such as a mute violin where the acoustic body is completely eliminated.

Other objects of the invention are to provide a novel and improved pickup which involves a simple modification of conventional types in an economical, easy manner, which is adapted to both crystal and magnetic types of pickups and which performs in a reliable, predictable manner.

With the foregoing and other objects in view, all of which more fully hereinafter appear, my invention comprises certain constructions, combinations and arrangements of parts and elements as hereinafter described, defined in the appended claims and illustrated in the accompanying drawings in which:

Figure 1:
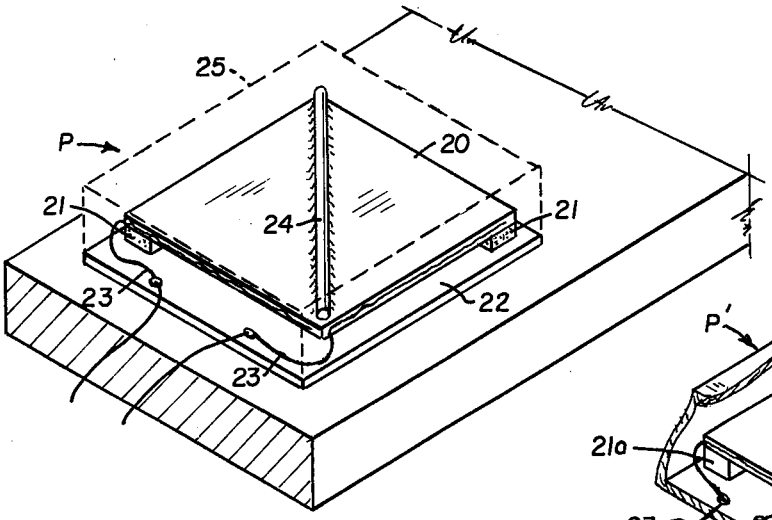
Fig. 1 PRIOR ART
FIG. 1 is an isometric view of a portion of an instrument stick with a conventional pickup mounted thereon, on an enlarged scale, with the cover removed and its outline shown in broken lines to illustrate a square-type crystal therein.

Referring more particularly to the drawing, a common type of pickup uses a piezoelectric crystal transducer formed as a thin, flat member. The crystal transducer may be made from quartz, barium titanate, lithium sulphate, lead metaniobate and lead zirconate-titanate. These crystals will range in size from 1/16 inch to 5 inches. The crystal transducers may be circular, rectangular or square in plan. Electrical leads extend from adjacent sides of the crystals to produce a voltage output which may be picked up with a suitable electronic amplifier.

FIG. 1 shows a typical pickup P, whose transducer is a square crystal 20 mounted upon a pair of diagonally opposite, resilient pads 21 which, in turn, are mounted upon a base 22. This base 22 is attached to a vibrating member such as the body B of an instrument. Suitable output wires 23 are affixed to the sides of this crystal 20 to pick up voltage fluctuations which are produced by minute movements of the crystal. Essentially, the crystal vibrates under its own weight, but it may be supplemented by a small ballast, a metal wire 24 cemented to the upper face of the crystal. In the unit shown at FIG. 1, this wire 24 extends diagonally across the face of the crystal at the diagonal opposite the resilient corner supports 21. To complete the pickup, it may be housed in an inverted cup-like container 25, shown in broken lines at FIG. 1.

Figure 2:
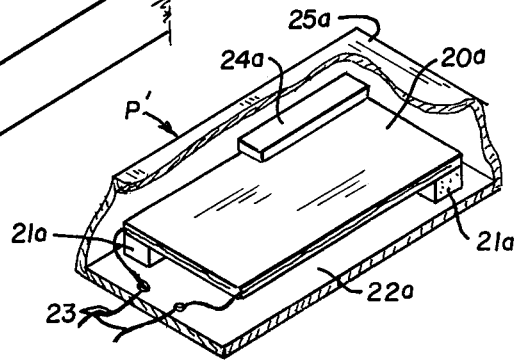
Fig. 2 PRIOR ART
FIG. 2 is an isometric view of another conventional pickup, on an enlarged scale and with portions of the cover removed to illustrate a rectangular crystal therein.

FIG. 2 shows another type of pickup P′ using a rectangular crystal 20*a*. It is mounted upon a pair of diagonally-opposite, resilient pads 21*a*, which upstand from a base 22*a*. A voltage output proportional to the flexure of the crystal is picked up by wires 23. A ballast in the form of a small bar 24*a* at one side of the crystal supplements the vibration action of the unit. A housing 25*a*, an inverted cup-like container, encloses these components to complete the unit.

Another type of pickup, not shown, uses electromagnetic action to drive a transducer. In one form of this unit, an armature or the equivalent thereof is disposed in a coil. The slight movement by the armature, produced by vibrations changes the inductance of the coil. Another type of electromagnetic pickup uses a vibrating string as the armature.

Both the crystal transducers and the electromagnetic transducers are designed to operate in the sonic range, which varies from 40 to 20,000 HZ. The natural frequency of crystals is normally much greater than this range, and, therefore, they will easily respond to any of the several frequencies of the sonic range. The magnetic transducers have a greater inertia and may be able to operate only in a limited spectrum of the sonic range of sound. Thus, several magnetic transducers may be required in a single instrument. In testing pickups to show the efficiency of the present invention, it was found that the magnetic transducers would behave very much like crystal transducers, and, therefore, after this fact was established, the tests and results, as hereinafter set forth, concern pickups with crystal transducers.

The invention herein set forth consists essentially in the simple step of loading a pickup with a mass which greatly exceeds the weight of the crystal. As noted, a ballast consisting of a metal wire or a pad has been used in conventional pickups, such as the diagonal rod 24 illustrated at FIG. 1 or an off-set pad 24*a* as illustrated at FIG. 2. Such members are affixed to the crystal with a suitable cement. Compared with the weight of the crystal, the weight of these conventional ballast members is in the ratio of approximately one to one. The situation is otherwise in the present invention. This mass, as hereinafter further described, will be as much as ten times the crystal weight or more, and preferably as much as 50 times the crystal weight.

From the above, it is apparent that a pickup constructed according to the present invention is most applicable to instruments of lower quality since it is not needed in a high quality instrument. A delicately made pickup will faithfully pick up all tones of an instrument, even the dissonant tones of a poorly made instrument. Another factor which appears in the response of a pickup to a vibrating string resides in the fact that as the vibration of the string attenuates, there will be a point at which the instrument and/or the pickup will not sense the string vibration and the physical result will be a rather abrupt cutoff of the tone. This is herein referred to as the sustain time, and too short a sustain time will produce a staccato or tinny tone instead of a desired, sustained and gradually fading tone. The physical action which produces this effect is not too fully understood. It is less noticeable with high quality instruments and is also less noticeable with certain types of high quality, expensive pickups when used with good instruments. The present invention is, thus, especially useful with cheaper types of pickups to improve their performance and output. However, the performance of high quality, expensive pickups is also improved by the invention.

The present invention provides for the loading of a pickup with a mass in any one of several manners. Apparently, this loading creates an inertia background which inhibits the production of dissonant tones, especially of high pitch, scratch sounds which are common in cheap instruments. One explanation is that this added mass to supplement the pickup produces an action which is more nearly resonant at the frequencies encountered by the tones of the stringed instruments. This is suggested by the fact that in one test a ratio of mass to crystal weight of about 88 caused the crystal to resonate. However, as heretofore mentioned, an unloaded crystal will have a natural frequency much greater than the tones in the audible range.

The application of mass to a pickup is somewhat the antithesis of known pickup design. The criteria of design is, conventionally, to minimize the inertia associated with the pickup crystal to permit the most delicate variations and overtones produced by the instrument to respond to the pickup. An instrument reflects and reinforces tones produced by the strings upon it. Also, the vibration action of the instrument body, generated by these strings, can produce other tones which may be off-pitch vibrations. This is especially noticeable in poorly made instruments and the art of building high quality instruments is resolved about the elimination of such dissonant tones and proper amplification of a string tone at any pitch.

Adding a significant mass to the pickup improves the performance of the pickup surprisingly, although it is not entirely clear as to whether the pickup is more faithfully reproducing the string tones of the instrument or whether it is adding something to the tone quality in an almost synergistic manner due to the additional inertia imposed upon the system. The manner in which the mass is added is immaterial providing that the mass can act in some manner against the crystal to force the crystal to vibrate against it. This means that the crystal will be positioned, or at least functionally positioned, between the mass and the vibrating surface whereon the pickup is mounted. The mass may be spaced a short distance from the face of the crystal although good results are also obtained where the mass is actually placed against the crystal or upon a pad affixed to the crystal. The mass can be cemented to corners or spots on a crystal, but it cannot be totally cemented tightly to the crystal with a hard cement. On the other hand, good performance is possible if the mass is cemented to the crystal with a soft, resilient cement.

It is desirable, though not essential, to encapsulate the pickup, or the crystal forming the pickup, within a resin body which contains a mass providing that the crystal is arranged within a cavity or a resilient resin is used adjacent to the crystal, such as a rubber or plastic foam, to permit vibration of the crystal to occur. If the resin body is a resilient, open-pore foam body, it may completely embed the crystal. A compound type of embodiment is also possible where a hard shell of epoxy-type resin is used with a flexible, urethane-type foam against at least one side of the crystal.

Figure 4:
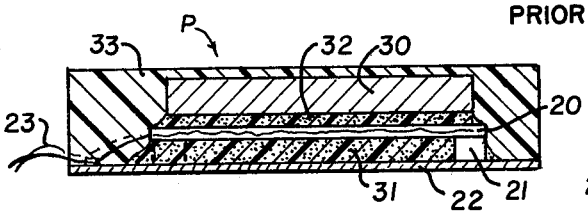
FIG. 4 is an enlarged sectional view of a pickup of the type illustrated at FIG. 1 modified according to one arrangement of the invention.

FIG. 4 illustrates a pickup P, such as that shown at FIG. 1, within a compound embedment and including a mass 30. A resilient resin filler 31 lies between the crystal 20 and the base 22 of the pickup and a thin layer of resilient resin 32 lies between the crystal 20 and the mass 30. This mass 30 may be, and preferably is, a metal plate proportioned to overlie a substantial part of the crystal. The pickup P, the filler 31, the resin layer 32 and the mass 30 are within a box-like embedment 33 of a hard, comparatively rigid resin which rests upon, and exposes only the lower surface of the base 22. However, the output wires 23 are extended through this embedment for connection with a readout apparatus.

Figure 5:
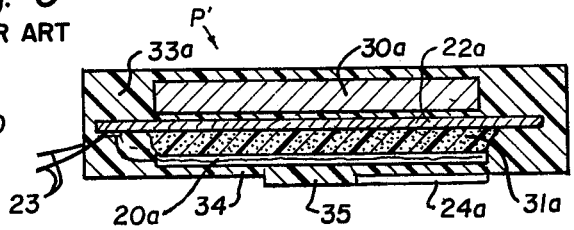
FIG. 5 is an enlarged sectional view of a pickup of the type illustrated at FIG. 2 modified according to a second arrangement of the invention.

FIG. 5 illustrates a pickup P', such as that shown at FIG. 2, within a compound embedment and including a mass 30. A resilient resin filler 31*a* lies between the crystal 20*a* and the base 22*a* and the pickup P' and mass 30 are enclosed within a box-like embedment 33*a* of a hard resin. However, in this arrangement, the pickup P' is inverted with the base 22*a* being the center of the embedment adjacent to the mass 30*a*. A thin underlayer 34 of hard resin covers the underside of the crystal 20*a* to provide a surface whereagainst the unit is mounted as upon a musical instrument. A center mounting boss 35 may be provided at the center of this underlayer 34 to more effectively transmit vibrations from the instrument to the crystal 20*a*.

Figure 6:
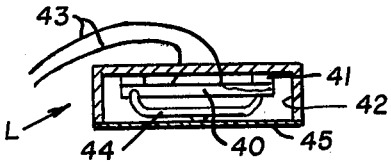
Fig. 6 PRIOR ART
FIG. 6 is an enlarged sectional view of a lapel microphone.

FIG. 6 illustrates a conventional lapel microphone L wherein a square pickup crystal 40 is carried on diagonally opposed, resilient supports 41 which, in turn, are within a cup-like container 42 with output leads 43 extending therefrom. A connector bar 44 extends diagonally across this crystal opposite the supports 41 and contacts the center of a diaphram 45 across the opening of the container 42 to enclose the crystal 40, its supports 41 and the bar 44.

Figure 7:
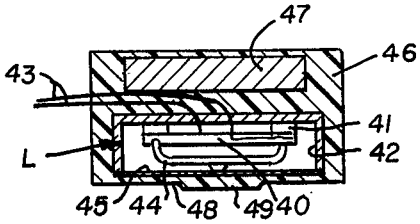
FIG. 7 is an enlarged sectional view of the lapel microphone modified according to the invention to adapt the same for use as an instrument pickup.

FIG. 7 shows the lapel microphone L of FIG. 6 embedded within a resin block 46. Also, a plate-like mass 47 is embedded in this block above the container 42 to act upon the microphone L. The embedment 46 includes a thin layer 48 at the diaphram 45, with a boss-like pad 49 projecting from the center of the diaphragm of the microphone L. The embedded microphone will be mounted upon an instrument on this pad 49 so that vibration action will be against the diaphragm 45 to the connector bar 44 and to the crystal 40. The mass above the crystal acting thereon through the container 42 produces the increased output.

Figure 8:
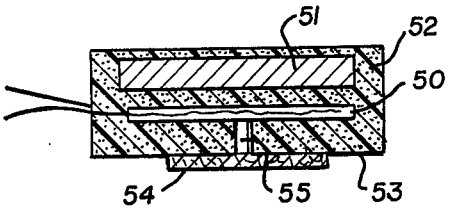
FIGS. 8 and 9 are enlarged sectional views of simplified, encapsulated pickups constructed according to the invention.

FIG. 8 illustrates another modification of a pickup using a crystal 50 similar to the crystal 20 of FIG. 1. This crystal is embedded in a resilient resin 52, such as an open-pore foam body. This embedment 52 includes a mass 51 which overlies and is spaced a short distance from the crystal 50. The mounting side 53 of the embedment, opposite to the location of the mass 51 with respect to the crystal 51, carries a mounting pad 54 which may be of a material such as felt. A rigid pin 55 extends from this pad 54 to the crystal 50 to act upon the crystal.

Figure 9:
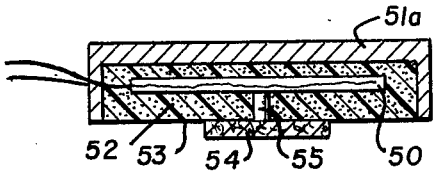

The arrangement shown at FIG. 9 is essentially identical to that of FIG. 8, excepting that the mass 51*a* is formed as a weighted cup to contain the embedment 52.

Figure 10:
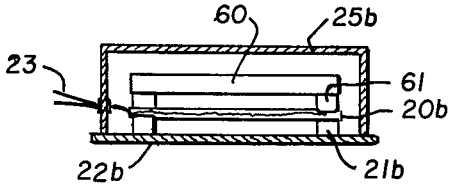
FIGS. 10 and 11 are enlarged sectional views of conventional pickups modified according to yet other arrangements of the invention.

FIG. 10 illustrates one manner of applying a mass to a pickup without the use of an embedment. A crystal 20*b* is mounted at diagonally-opposed corners of the crystal pads 21*b*, which, in turn, are carried upon a base 22*b*. A mass 60 is carried upon the crystal 20*b*, upon diagonally-opposed pads 61, which are at the opposite corners of the crystal 20*b* from the corners supported by pads 21*b*. This simple arrangement is housed in a cup-like container 25*b* mounted upon the base 22*b*.

Figure 11:
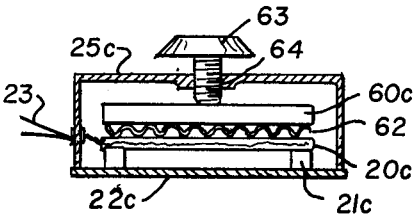

FIG. 11 is similar to the arrangement shown at FIG. 10 excepting that the mass 60*c* is supported upon a crystal 20*c* by a resilient pad 62 illustrated as being of corrugated material. This pad 62, however, is very soft and may be of felt or fiber providing that it has some degree of resilience. Supplementing the mass, a pressure screw 63 is mounted in a threaded socket 64 in the top of an enclosing cup-like container 25*c*. The pressure of the screw 63 causes the mass to press against the crystal with an increase in output as the pressure of the screw 63 increases.

Figure 12:
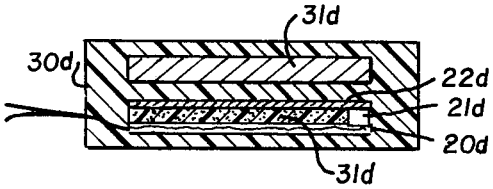
FIG. 12 is an enlarged sectional view using a pickup similar to the type shown at FIG. 1 on yet another arrangement of the invention.

FIG. 12 shows the basic components of a crystal-type pickup, such as shown at FIG. 1, in an arrangement similar to that of FIG. 5. A crystal 20 is mounted upon diagonally-opposed supports 21*d* which are, in turn, connected to a base 22*d*. The space between the crystal 20*d* and the base 22*d* is filled with a resilient, closed-pore foam 31*d*. The pickup and a mass 30*d* are then encapsulated in a resin block 33*d* with the crystal 20*d* therein being adjacent to a flat mounting surface 34*d* of the block, and with the base 22*d* being within the block between the crystal and the mass 30*d*.

Figure 3:
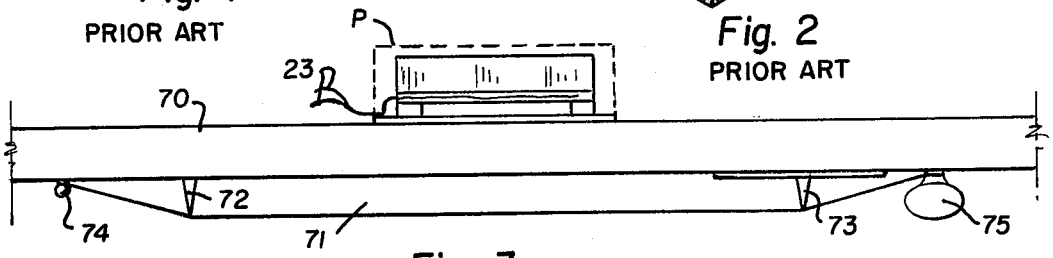
Fig. 3 PRIOR ART
FIG. 3 is a side elevational view of an instrumental stick arranged for testing different types of pickups to physically demonstrate and compare the properties of various types of pickups.

A number of tests were made to quantitatively determine the performance of these several arrangements of pickups, as well as other types of pickups, when mass was added to the pickup. The discovery of improved performance, when mass was added, resulted from listening to a number of pickups on different instruments. Naturally, such observations can be considered only qualitative, although they did show that the performance of both crystal pickups and magnetic pickups was improved. To observe the improvement in a quantitative manner, the apparatus illustrated at FIG. 3 was set up. This apparatus included an instrument stick 70 having a tone string 71 mounted at one side thereof between a fixed bridge 72 and a similar adjustable nut 73. The string was anchored at one end on a post 74 and to an adjusting nut 75. Thus, it was possible to vary the string span and tension to produce any desired tone. To complete the unit, a pickup P was mounted upon the opposite side of this stick for testing. The output leads 23 of the pickup were connected with an oscilloscope to measure the output voltage and to visually show the time period through which the diminishing string vibrations would be recorded by the pickup, which is referred to as "sustain time" at FIG. 13. A mechanical device, not shown, was used to pluck the string 71 to provide the same impulse to the string every time it was vibrated.

Figure 13:
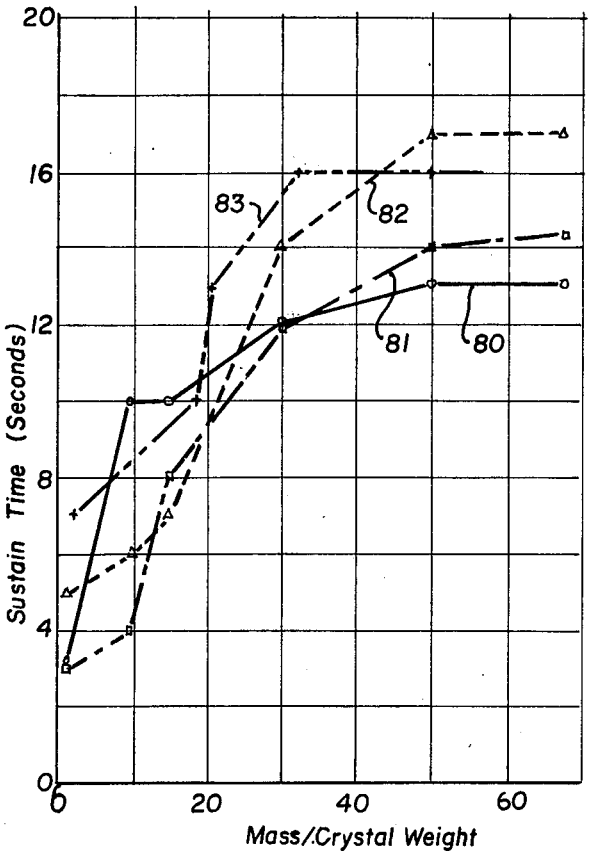
FIGS. 13 and 14 illustrate comparative test results obtained with several pickups to show sustain time and pickup output for various loadings to the pickups.
Figure 14:
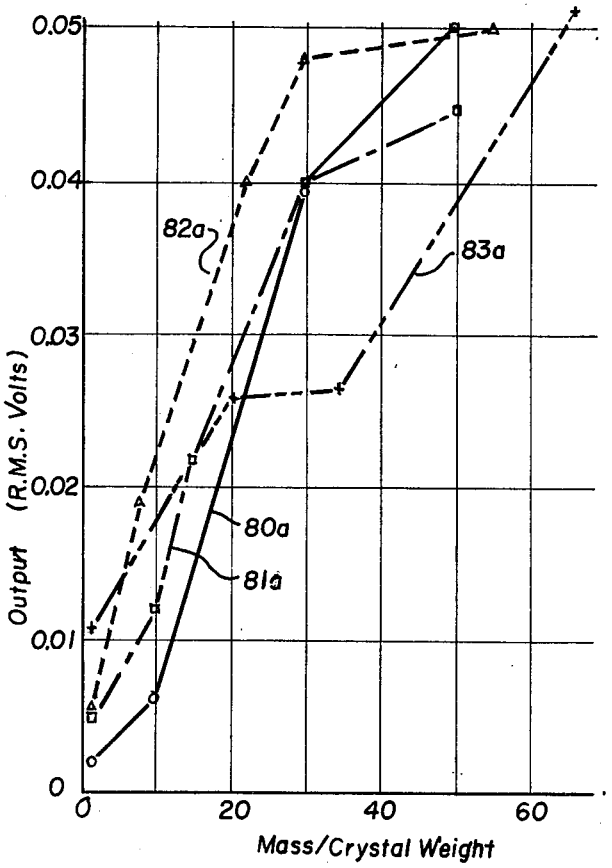

The tests thus measured the sustain time, FIG. 13, and the output voltage for the various pickups and for pickups to which a mass has been added. The characteristics of four different pickups is shown at FIGS. 13 and 14. These characteristics are exemplified as graphs where the abscissa at both figures is the ratio of mass to crystal weight, the ordinate at FIG. 13 is sustain time in seconds and the ordinate at FIG. 14 is the output in R.M.S. volts.

Curves 80 and 80*a* show tests for a harmonica pickup constructed similar to the unit illustrated at FIG. 1. Curves 81 and 81*a* shows tests for a harmonica pickup similar to FIG. 2 and curves 82 and 82*a* show tests for a lapel microphone, similar to FIG. 6 and modified by encapsulation according to FIG. 7 when mass was added. Curves 83 and 83*a* are for an expensive guitar pickup, although the abscissa values of these curves may not be precise since the weight of the crystal within the pickup had to be approximated because it was enclosed in a case.

FIG. 13 illustrates that without added mass other than the conventional rod or pad, such as 24 at FIG. 1 or 24*a* at FIG. 2, the sustain time for these conventional pickups tested varies from 3 to 6 seconds. A mass is added, the sustain time increases, a significant increase in time commencing with a mass/crystal weight ratio exceeding approximately 15 and becoming a maximum of 13 to 17 seconds when the ratio is approximately 50. This would indicate that the string 71 actually vibrated 17 seconds or longer, but the conventional pickups would not register the diminishing string tone after about 5 seconds. Thus, the addition of mass to a pickup which will exceed the crystal weight as much as 50 times can produce a desirable sustaining of a string tone not possible with an unmodified conventional instrument.

More surprisingly, however, is that the output of the pickups is increased. FIG. 14 illustrates that without added mass, the power output for these conventional pickups tested varies from approximately 0.002 to 0.01 volts. As mass is added, the output as shown by the curves increases to as much as 0.05 volts at a mass/crystal weight ratio of approximately 50. Other tests, not set forth, have shown an output as great as 0.085 volts will be obtained for certain types of pickups for a mass to crystal weight ratio of approximately 50.

I have now described my invention in considerable detail. However, it is obvious that others skilled in the art can build and devise alternate and equivalent constructions and operations which are nevertheless within the spirit and scope of my invention. Hence, I desire that my protection be limited, not by the constructions and operations illustrated and described, but only by the proper scope of the appended claims.

What is claimed is:

1. A pickup for a stringed instrument, or the like, comprising, in combination therewith:

a. a body structure which is mounted upon said instrument;

b. a transducer means within the body structure arranged to respond to vibrations generated by said instrument and produce electrical signals corresponding to such vibrations; and c. a mass, whose weight is substantially greater than the weight of the transducer means, mounted on the body, with the transducer means being effectively positioned between the mass and the instrument, whereby to cause the transducer means to react against the mass whenever it is responding to vibrations generated by the instrument.

2. The pickup structure defined in claim 1, wherein:

the transducer means is a crystal; and the weight of said mass is greater than 10 times the weight of the crystal.

3. The pickup defined in claim 2, wherein:

the ratio of mass weight to crystal weight will vary from 15 to 60.

4. In the pickup defined in claim 1, wherein:

the transducer means is a flat crystal which flexes and vibrates responsive to vibrations of the instrument;

the mass includes a flat surface and is mounted on the body adjacent to the crystal with the flat surface lying in spaced parallelism with an adjacent face of the crystal; and partial contact means between the mass and the crystal to effect a partial engagement of the crystal and the mass to thereby permit the crystal to react against the mass as it vibrates without such vibrations being inhibited by the mass.

5. The pickup defined in claim 4, wherein:

the mass and the crystal are mounted within an embedment; and said partial contact means includes a clearance within the embedment between the crystal and the mass.

6. The pickup defined in claim 5, wherein:

said clearance is filled with a resilient, expanded foam.

7. In the pickup defined in claim 1, wherein:

the transducer means is a flat crystal which flexes and vibrates responsive to vibrations of the instrument;

the mass includes a flat surface and is mounted on the body adjacent to the crystal with the surface being in spaced parallelism with the adjacent face of the crystal; and partial contact means between the mass and the crystal effecting a partial engagement of the crystal and the mass to thereby permit vibrations of the crystal to react against the mass without being inhibited by the mass.

8. The pickup defined in claim 7, wherein said partial contact means comprises:

supports at opposite corners of the crystal.

9. In the pickup defined in claim 1, including:

a driver contact means between the crystal and the instrument top at the central portion of the crystal and wherein the mass engages the crystal at the peripheral portion of the crystal whereby to enhance the vibration effect at the crystal.

10. A method for enhancing the output and tone sustaining quality of an acoustic pickup mounted upon a stringed instrument, or the like, said pickup including a transducer means to convert sound vibrations into corresponding electrical signals and including the steps of:

a. adding a mass to the pickup which greatly exceeds the mass of the transducer means, with the transducer means being positioned between the instrument and the mass;

b. partially contacting the transducer means and the mass to permit vibrations of the transducer means to act against the mass without being inhibited by the mass; and c. providing a mounting means between the transducer means and the musical instrument to impart vibrations generated by the instrument to the transducer means.

11. In the method defined in claim 10, wherein the transducer means includes:

a crystal; and the weight of the mass is 10 to 60 times greater than the weight of the crystal.

* * * * *